US011586129B2

(12) United States Patent
Deno

(10) Patent No.: US 11,586,129 B2
(45) Date of Patent: Feb. 21, 2023

(54) IMAGE FORMING APPARATUS CAPABLE OF SHEET POSITION CORRECTION

(71) Applicant: CANON KABUSHIKI KAISHA, Tokyo (JP)

(72) Inventor: Kohei Deno, Moriya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/428,280

(22) Filed: Feb. 9, 2017

(65) Prior Publication Data

US 2017/0235254 A1 Aug. 17, 2017

(30) Foreign Application Priority Data

Feb. 16, 2016 (JP) ..... JP2016-027062

(51) Int. Cl.
*G03G 15/00* (2006.01)
*G03G 15/16* (2006.01)
*G03G 15/23* (2006.01)

(52) U.S. Cl.
CPC ..... *G03G 15/16* (2013.01); *G03G 15/235* (2013.01); *G03G 15/6529* (2013.01); *G03G 15/6567* (2013.01)

(58) Field of Classification Search
CPC ..... G03G 15/6561; G03G 15/6567; G03G 15/6555; G03G 15/16; G03G 15/235; G03G 15/6529
See application file for complete search history.

(56) References Cited

U.S. PATENT DOCUMENTS 8,348,266 B2 1/2013 Deno
8,540,240 B2 9/2013 Deno et al.
9,248,979 B2 * 2/2016 Sako ..... B65G 47/24
9,348,291 B2 5/2016 Yamamoto
(Continued)

FOREIGN PATENT DOCUMENTS

JP 2009-143643 A 7/2009

OTHER PUBLICATIONS

Depending, unpublished U.S. Appl. No. 15/425,116 to Kohei Deno dated Feb. 6, 2017.

(Continued)

*Primary Examiner* — Jennifer Bahls
*Assistant Examiner* — Quang X Nguyen
(74) *Attorney, Agent, or Firm* — Venable LLP

(57) ABSTRACT

An image forming apparatus includes an image forming portion to form an image on an image bearing member, and a transfer portion to transfer the image on a first image position on the image bearing member to a sheet. In addition, a controller determines a second image position, on the image bearing member, of an image to be transferred onto a second surface of a sheet re-conveyed to an adjustment portion by a reverse and re-conveyance portion based on a detected side edge position, of a trailing part of the sheet being conveyed with a first end as the leading edge. The trailing part of the sheet is positioned on a trailing edge side further than a center position, in the sheet conveyance direction, of the sheet, and the controller determines a shift amount based on the second image position and detected side edge position of the sheet, which has been re-conveyed, being conveyed with the second end as the leading edge.

14 Claims, 8 Drawing Sheets

(56) References Cited

U.S. PATENT DOCUMENTS

| | | | | |
|---|---|---|---|---|
| 9,581,928 | B2 | 2/2017 | Deno | |
| 2007/0065200 | A1* | 3/2007 | Asaba | G03G 15/6567 399/394 |
| 2007/0264066 | A1* | 11/2007 | Peng | G03G 15/5062 399/395 |
| 2012/0141179 | A1* | 6/2012 | Atsumi | G03G 15/6567 399/381 |
| 2015/0378297 | A1* | 12/2015 | Nakura | G03G 15/5029 399/395 |
| 2016/0159598 | A1* | 6/2016 | Yamane | B65H 9/20 271/227 |

OTHER PUBLICATIONS

Copending, unpublished U.S. Appl. No. 15/425,126 to Kohei Deno dated Feb. 6, 2017.
Kohei Deno, U.S. Appl. No. 15/425,126, filed Feb. 6, 2017.
Kohei Deno, U.S. Appl. No. 15/425,116, filed Feb. 6, 2017.

* cited by examiner

X1: LEADING EDGE OF FIRST SURFACE
L1t: DETECTED POSITION OF SIDE EDGE ON LEADING PART IN FORMING IMAGE ON FIRST SURFACE

FIG.6A

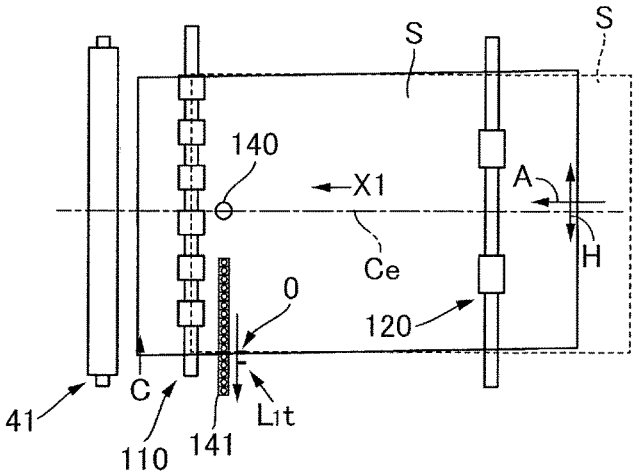

FIG.6B

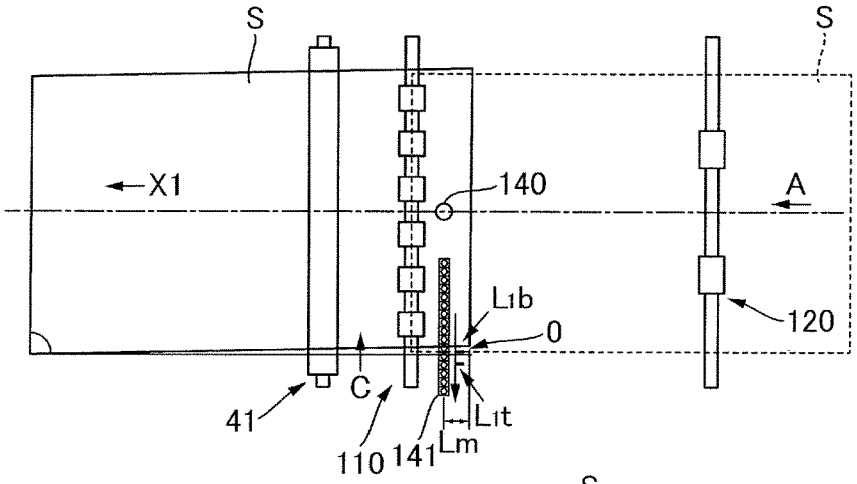

FIG.6C

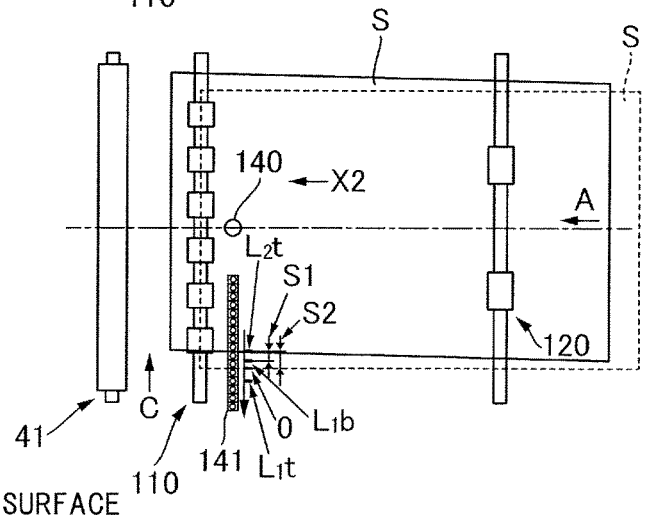

X1: LEADING EDGE OF FIRST SURFACE
X2: LEADING EDGE OF SECOND SURFACE (= TRAILING EDGE OF FIRST SURFACE)
S1: SHIFT AMOUNT OF PRESENT EMBODIMENT
S2: SHIFT AMOUNT OF COMPARATIVE EXAMPLE
$L_1b$: DETECTED POSITION OF SIDE EDGE ON TRAILING PART IN FORMING IMAGE ON FIRST SURFACE
$L_1t$: DETECTED POSITION OF SIDE EDGE ON LEADING PART IN FORMING IMAGE ON FIRST SURFACE
$L_2t$. DETECTED POSITION OF SIDE EDGE ON LEADING PART IN FORMING IMAGE ON SECOND SURFACE

DETECTED POSITION OF SIDE EDGE ON LEADING PART IN FORMING IMAGE ON FIRST SURFACE AFTER SHIFT CORRECTION (L1t)

DETECTED POSITION OF SIDE EDGE ON TRAILING PART IN FORMING IMAGE ON FIRST SURFACE (L1b)

DETECTED POSITION OF SIDE EDGE ON LEADING PART IN FORMING IMAGE ON SECOND SURFACE (L2t)

SHIFT AMOUNT (PRESENT EMBODIMENT)

SHIFT AMOUNT (COMPARATIVE EXAMPLE)

X1: LEADING EDGE OF FIRST SURFACE
X3: CONVEYANCE SHIFT OF SECONDARY TRANSFER
L1b: DETECTED POSITION OF SIDE EDGE ON TRAILING PART IN FORMING IMAGE ON FIRST SURFACE
L1t DETECTED POSITION OF SIDE EDGE ON LEADING PART IN FORMING IMAGE ON FIRST SURFACE

IMAGE FORMING APPARATUS CAPABLE OF SHEET POSITION CORRECTION

BACKGROUND OF THE INVENTION

Field of the Invention

The present disclosure relates to an image forming apparatus such as a copier, a printer, a facsimile, and a multifunction printer.

Description of the Related Art

Hitherto, some image forming apparatuses configured to form an image on a sheet include a mechanism for correcting a sheet position (lateral registration position) by shifting the sheet in a width direction orthogonal to a sheet conveyance direction for example to align the sheet with the image to be formed on the sheet. Some image forming apparatuses also include a sheet conveyance apparatus having a function of correcting a position and attitude (inclination) of the sheet conveyed to an image forming portion as described above.

Lately, with an increase of productivity of an image forming apparatus, a time that can be consumed for such processes as a shift operation, made by a registration roller pair to correct the sheet position, and a return operation after the shift is shortened. There is a possibility that the return operation is not completed within a predetermined time if a deviation of a sheet heading toward the image forming portion is large because a moving amount of the sheet in correcting the deviation becomes large. For instance, there is a case when a sheet is 'twisted' if the shift amount of the registration roller pair increases. As a result, the sheet being conveyed is skewed or accuracy of the shift is degraded. Accordingly, it is desirable to minimize the shift amount in correcting the deviation.

Still further, with downsizing of the image forming apparatus, a distance between a registration roller pair having a shift mechanism and a conveyance roller located upstream in a sheet conveyance direction tends to be shortened. Then, it is desirable to release all conveyance rollers nipping the sheet, other than the registration roller pair, in making the shift operation by the registration roller pair. However, this arrangement may go against downsizing of the apparatus and may incur high cost by complicating a configuration of the apparatus.

In view of the circumstance described above, there is proposed an image forming apparatus adopting a system configured to control so as to minimize a shift amount by adding a detection result in a width direction of a certain sheet to an image forming position of a sheet following the certain sheet by a predetermined number of sheets as disclosed in Japanese Patent Application Laid-open No. 2009-143643 for example. This image forming apparatus includes a mechanism configured so as to butt a leading edge of a sheet conveyed by a pre-registration roller pair disposed upstream of the registration roller pair against a nip portion of the registration roller pair to deflect the sheet and to correct a skew of the leading edge of the sheet. This image forming apparatus also includes a widthwise correction mechanism for correcting a widthwise position of the sheet. This widthwise correction mechanism includes a detection portion configured to detect widthwise side edge positions of the sheet and a shift mechanism configured to shift the registration roller pair in the width direction while nipping the sheet.

In general, it is rare when an angle of four corners of a sheet is strictly 90 degrees, and the sheet may be formed into a parallelogram in which widthwise edge positions (side edge positions) deviate by around 1.0 mm at leading and trailing edges in the sheet conveyance direction for example. If such sheet is used in printing for example, even if a shift operation of a first surface of the sheet is correctly performed and an edge position of the sheet being conveyed does not deviate in duplex printing, the leading and trailing edges are switched and a widthwise edge position of a second surface of the sheet deviates by 1.0 mm to an opposite side when the sheet is switched back and conveyed. Even when the sheet is conveyed askew by a secondary transfer roller while forming the image of the first surface or is conveyed while gradually turned, the widthwise side edge position of the second surface after the switchback is detected as being offset by the obliquely conveyed amount or the amount of turn because the widthwise side edge position at the trailing part deviates.

While the image forming apparatus disclosed in Japanese Patent Application Laid-open No. 2009-143643 adopts the control system of adding the widthwise detection result of the certain sheet to the image forming position of the sheet following by the predetermined number of sheets, nothing is mentioned about a first surface or a second surface. That is, regardless of that the widthwise edge position of the second surface after the switchback is detected as being offset by the obliquely conveyed amount or the amount of turn as described above, the control is made by assuming that an image drawing position of the second surface is equal with that of the first surface. Therefore, according to the technology of the image forming apparatus disclosed in Japanese Patent Application Laid-open No. 2009-143643, there remains a problem that an amount shift made by the registration roller pair in the width direction of the second surface becomes large corresponding to a deviation amount of the widthwise edge position at the trailing part of the sheet whose first surface is being conveyed.

SUMMARY OF THE INVENTION

According to one aspect of the present invention, an image forming apparatus includes an image forming portion configured to form an image on an image bearing member, a transfer portion configured to transfer the image on the image bearing member to a sheet, an adjustment portion disposed upstream in a sheet conveyance direction of the transfer portion and configured to adjust a position of the sheet in a width direction orthogonal to the sheet conveyance direction by shifting the sheet in the width direction while nipping and conveying the sheet downstream, a detection portion configured to detect one side edge position of the sheet in the width direction, a reverse and re-conveyance portion configured to reverse the sheet, on a first surface of which the image has been transferred by the transfer portion while being conveyed in a condition in which a first end is a leading edge, such that a second end opposite from the first end of the sheet becomes a leading edge and to re-convey the sheet to the adjustment portion, and a controller configured to determine a second image position, on the image bearing member, of an image to be transferred onto a second surface of the sheet re-conveyed to the adjustment portion by the reverse and re-conveyance portion based on a side edge position, detected by the detection portion, of a trailing part of the sheet being conveyed with the first end as the leading edge, the controller being configured to determine a shift amount by which the adjustment portion shifts the sheet re-conveyed by the reverse and re-conveyance portion based on the second image position and a side edge position, detected by the detection portion, of the sheet, which has been re-conveyed by the reverse and re-conveyance portion, being conveyed with the second end as the leading edge.

Further features of the present invention will become apparent from the following description of exemplary embodiments with reference to the attached drawings.

BRIEF DESCRIPTION OF THE DRAWINGS

FIG. 6A is a plan view illustrating a condition in which a widthwise position of the sheet has been corrected from the condition illustrated in FIG. 5A.

FIG. 6B is a plan view illustrating a condition of detecting a trailing part of the sheet from the condition illustrated in FIG. 6A.

FIG. 6C is a plan view illustrating a condition in which the sheet illustrated in FIG. 6B is conveyed again by having been reversed.

DESCRIPTION OF THE EMBODIMENTS

First Embodiment

Figure 1:
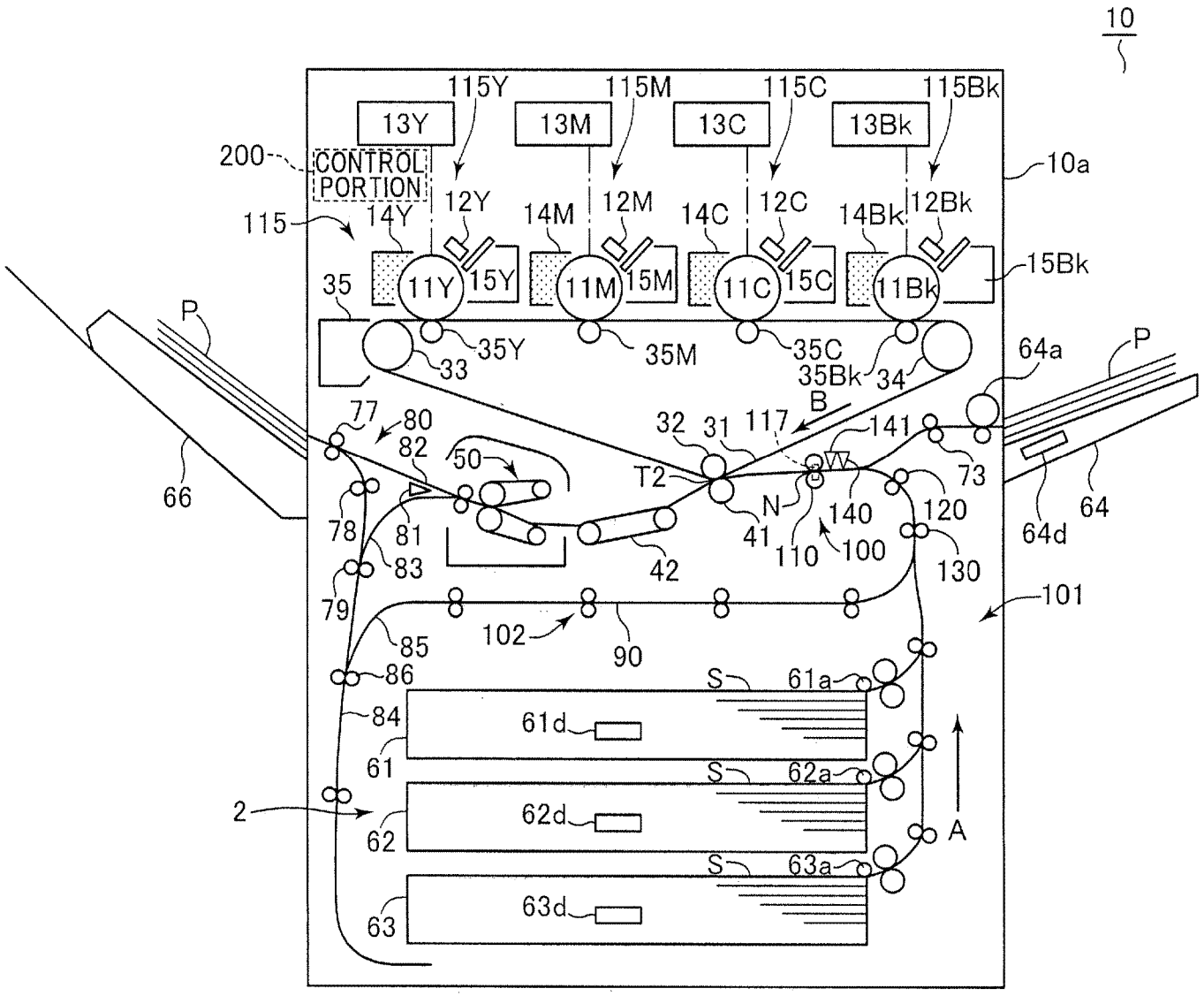
FIG. 1 is a schematic longitudinal section view illustrating an image forming apparatus of a first embodiment of the present disclosure.

An image forming apparatus of a first embodiment will be described with reference to the drawings. FIG. 1 is a schematic longitudinal section view illustrating the image forming apparatus of the first embodiment.

Image Forming Apparatus

As illustrated in FIG. 1, the image forming apparatus is a color image forming apparatus adopting an electro-photographic system for example. It is noted that lately, an intermediate transfer tandem system in which image forming portions of four colors are arrayed in tandem on an intermediate transfer belt and which excels in adaptability for various kinds of sheets (e.g., sheets of paper) and in printing productivity has become main stream. Then, the image forming apparatus 10 of the present embodiment will be described as having an image forming unit 115 of the intermediate transfer tandem system.

As illustrated in FIG. 1, the image forming apparatus 10 mainly includes the image forming unit 115, a secondary transfer portion T2, and a sheet conveyance apparatus 101. Each of the image forming portions 115Y, 115M, 115C, and 115Bk in the image forming unit 115 includes a photosensitive drum 11, i.e., 11Y, 11M, 11C, and 11Bk, as a sensitive body corresponding to respective colors of yellow (Y), magenta (M), cyan (C), and black (Bk) and an electrifying unit 12, i.e., 12Y, 12M, 12C, and 12Bk. Each of the image forming portions 115Y, 115M, 115C, and 115Bk also includes exposure units 13, i.e., 13Y, 13M, 13C, and 13Bk, functioning as an image drawing portion and a developing unit 14, i.e., 14Y, 14M, 14C, and 14Bk. The image forming unit 115 also includes an intermediate transfer belt 31 stretched by a secondary transfer inner roller 32, a driving roller 33 and a tension roller 34. The image forming unit 115 further includes primary transfer rollers 35Y, 35M, 35C, and 35Bk disposed on an inner circumferential side of the intermediate transfer belt 31 so as to respectively face the respective photosensitive drums 11. It is noted that the image forming portions 115Y, 115M, 115C, and 115Bk compose the image forming unit 115 configured to form an image. It is also noted that the components in the respective image forming portions 115Y, 115M, 115C, and 115Bk will be denoted by reference numerals from which subscripts specifying the respective colors are omitted, unless necessary to specify the colors, in the following description to simplify the description.

In each of the image forming portions 115Y, 115M, 115C, and 115Bk, a surface of the photosensitive drum 11 serving as an image bearing member is uniformly electrified by the electrifying unit 12 in advance. Then, the exposure unit 13 is driven based on signals of image information to form an electrostatic latent image on the surface of the rotating photosensitive drum 11. Then, the electrostatic latent image formed on the surface of the photosensitive drum 11 undergoes a toner developing process of the developing unit 14 to be developed as a toner image. After that, the toner image receives predetermined pressure and electrostatic bias applied by the primary transfer roller 35 and is transferred onto the intermediate transfer belt 31.

Next, the intermediate transfer belt (image bearing member) 31 will be described. The intermediate transfer belt 31 suspended by the driving roller 33, the tension roller 34, the secondary transfer inner roller 32 and others is driven and conveyed in a direction of an arrow B in FIG. 1. Image forming processes of the respective colors of Y, M, C, and Bk performed in parallel are conducted with timing of superimposing a toner image onto the toner image of an upstream color primarily transferred onto the intermediate transfer belt 31. As a result, a full-color toner image is finally formed on the intermediate transfer belt 31 and is conveyed to the secondary transfer portion T2.

A sheet S, i.e., a member onto which an image is transferred is stored in a sheet feed cassette in sheet storage sheds 61, 62 or 63 or in a manual feed portion 64 per each size for example. Feed rollers 61*a*, 62*a* and 63*a* are disposed respectively at positions corresponding to the sheet storage sheds 61, 62 and 63, and a feed roller 64*a* is disposed at a position corresponding to the manual feed portion 64. When a sheet is fed by any one of the feed rollers 61*a* through 63*a* corresponding to the sheet storage sheds 61, 62 and 63, the sheet is conveyed to a registration roller pair 110 in a sheet conveyance portion 100 by passing through a conveyance roller pair 130, a pre-registration roller pair 120 and others. Still further, when a sheet is fed by the feed roller 64*a* corresponding to the manual feed portion 64, the sheet S is conveyed to the registration roller pair 110 by passing through a conveyance roller pair 73.

It is noted that the registration roller pair 110 composes an adjustment portion. The adjustment portion is disposed upstream in a sheet conveyance direction (a direction of an arrow A in FIG. 2) of the image forming unit 115 and is configured to align a position of the sheet S being conveyed with an image drawing position of the image forming unit 115 by shifting the sheet in a width direction (a direction of an arrow H in FIG. 2) orthogonal to the sheet conveyance direction while nipping and conveying the sheet downstream.

As illustrated in FIG. 1, the pre-registration roller pair 120, i.e., a rotator pair, conveys the sheet S such that a leading edge of the sheet S being conveyed butts against a nip portion of the registration roller pair 110 being at a standstill. Thereby, the pre-registration roller pair 120 corrects a skew of the sheet S together with the registration roller pair 110 by looping the sheet S. The registration roller pair 110 conveys the sheet S to the secondary transfer portion T2 by synchronizing timing when the toner image on the intermediate transfer belt 31 is transferred onto the sheet S. The secondary transfer portion T2 includes a toner image transfer nip portion composed of a secondary transfer inner roller 32 and a secondary transfer outer roller 41 facing with each other and applies the predetermined pressure and electrostatic bias to transfer the toner image onto the sheet S.

The sheet S on which the toner image has been transferred is conveyed by an air attracting conveyance portion 42 to a fixing unit 50 to melt and fix the toner image onto the sheet S by pressure and heat applied by the fixing unit 50. In a case when a conveyance mode of the sheet is a face-up conveyance, the sheet S is conveyed to a discharge portion 80. In a case of a face-down conveyance on the other hand, the sheet S is stopped once in a condition in which a trailing edge thereof is left by a predetermined distance from a reverse roller 79 and is then discharged by reversing the reverse roller 79 through a conveyance roller pair 78 and a discharge roller pair 77.

In a case of duplex printing, the sheet is stopped once in a condition in which the trailing edge thereof is left by a predetermined distance from a duplex reverse roller pair 86 and is conveyed to the sheet conveyance portion 100 again through a duplex conveyance path 90 by reversing the duplex reverse roller pair 86. Then, an image corresponding to a second surface of the sheet S is formed in the image forming unit 115. Fixing and discharging operations thereafter are carried out in the same manner with the case of the first surface.

The image forming apparatus 10 of the present embodiment will be described below by assuming that the image forming apparatus 10 adopts a center referenced sheet conveyance system of conveying a sheet by matching a center in the sheet conveyance direction of a sheet conveyance path with a widthwise center of the sheet for example. It is noted that the discharge roller pair 77, the duplex reverse roller pair 86, and the duplex conveyance path 90 compose a reverse and re-conveyance portion 102 configured to convey the sheet on which the image has been formed on the first surface thereof toward the image forming unit 115 after reversing the leading and trailing edges of the sheet. In other words, the reverse and re-conveyance portion 102 is configured to reverse the sheet, on a first surface of which the image has been transferred by the transfer portion while being conveyed in a condition in which a first end is a leading edge, such that a second end opposite from the first end of the sheet becomes a leading edge and to re-convey the sheet to the adjustment portion.

The sheet storage sheds 61, 62 and 63 are provided with size detecting mechanisms 61*d*, 62*d* and 63*d* for detecting sizes of the sheets S respectively stored in the sheet storage sheds 61, 62 and 63. Each size detecting mechanism 61*d*, 62*d* or 63*d* includes a side regulating plate not illustrated and regulating widthwise positions of the sheet S and a size detecting lever not illustrated, being turnable and being in slidable contact and interlocked with the side regulating plate. The side regulating plate is configured to be movable in accordance to a side edge part of the sheet S. Still further, the size detecting lever is configured such that when the side regulating plate is moved in accordance to the side edge part of the sheet S, the lever turns by interlocking with the move.

Each of the size detecting mechanisms 61*d*, 62*d* and 63*d* includes a plurality of sensors or switches disposed at positions corresponding to the size detecting lever in the condition in which the sheet feed cassette is attached to each of the sheet storage sheds 61, 62 and 63. When the sheet feed cassette is attached to the sheet storage shed, the size detection lever selectively turns ON/OFF a detector element of the sensor or the switch. Thereby, the image forming apparatus 10 receives a signal of a different pattern outputted from the sensor or the switch corresponding to the sheet S stored in the sheet feed cassette. A control portion 200 described later recognizes the size and others of the sheet S stored in the sheet feed cassette based on the received signal.

The size detecting mechanisms 61*d* through 63*d* also detect attachment/detachment in the sheet storage sheds 61 through 63, e.g., insertion or drawal of the sheet feed cassettes. For instance, the sheet feed cassettes are being drawn out of the sheet storage sheds 61 through 63, the detector elements of the sensor or the switch of the size detecting lever are all turned OFF. It is noted that the manual feed portion 64 may be provided with a similar mechanism as a size detecting mechanism 64*d* and an attachment/detachment detecting mechanism.

The side regulating plate suppresses a skew and widthwise deviation of the sheet S that may be caused while feeding the sheet S and at the respective conveyance rollers disposed downstream of the feed roller. However, actually there is a case when a slight gap is generated between the side regulating plate and the sheet S. The gap thus generated may cause the skew or the widthwise deviation of the sheet S in feeding and conveying the sheet S.

By being affected by looseness of the side regulating plate or by vibration and other caused in inserting and drawing the sheet feed cassette, a deviation of a center position of the sheet S in a front-rear direction commonly occurs in setting the sheet S in the sheet storage shed. There is also a case when a size of a sheet itself is slightly different from a nominal size (designed size) thereof. In such a case, the center position of the sheet continues to be offset by a certain value. Because the image forming apparatus in general is configured to control to shift a deviation itself, a shift amount of the registration roller pair also becomes large. There is also a case when the sheet S fed from the sheet storage shed skews during its conveyance or is obliquely conveyed in a condition of being shifted in the width direction. In order to prevent such conditions, a skew correcting operation and others are conducted in the sheet conveyance portion 100 included in the image forming apparatus 10. This point will be described in detail below.

The sheet conveyance portion 100 is configured to correct a skew by butting the leading edge of the sheet S being conveyed against the nip portion of the registration roller pair 110 being at a standstill to deflect the sheet and to align the leading edge of the sheet S along the nip portion. The control portion 200 (FIG. 3) sets a feed amount of the sheet S fed by the pre-registration roller pair 120 after when the leading edge of the sheet S passes through the registration sensor 140 (see also FIGS. 4 and 5) such that the sheet S forms an adequate amount of deflection.

A CIS (contact image sensor) 141 is disposed along the conveyance path between the registration roller pair 110 and the pre-registration roller pair 120. The CIS 141 is disposed at a position where the CIS 141 is lined up with the registration sensor 140 (see FIG. 5) in the width direction H orthogonal to the sheet conveyance direction A (see FIG. 2). It is noted that the CIS 141 composes a detection portion detecting one side edge position in the width direction of the sheet.

Based on a detection result of the CIS 141, the control portion 200 calculates a deviation amount between a nominal position (designed target position) and the detection result of the side edge position of the sheet. Based on the calculated deviation amount, the control portion 200 executes a shift operation of shifting the registration roller pair 110 in the sheet conveyance portion 100 in the width direction. In the sheet conveyance portion 100, the widthwise positon of the sheet S is thus corrected so as to coincide with a position of an image to be secondarily transferred by the image forming unit 115. It is noted that the controller is composed of the control portion 200 and the shift motor 151 (see FIGS. 2 and 3). In the present embodiment, the controller (151 and 200) shifts the registration roller pair 110 serving as the adjustment portion in the width direction H. The registration roller pair 110 corrects a skew of the sheet by the nip portion N against which the leading edge of the conveyed sheet butts.

Specific Configuration of Sheet Conveyance Portion

Figure 2:
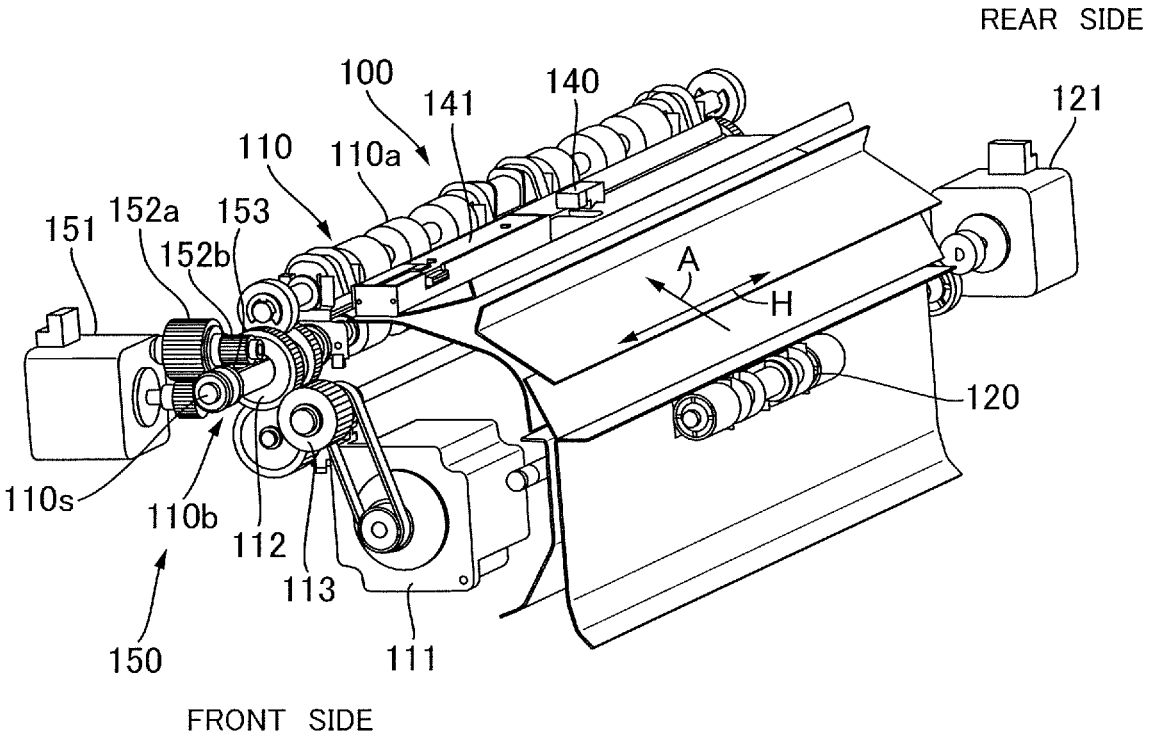
FIG. 2 is a perspective view illustrating a configuration of a main part of a sheet conveyance portion of the first embodiment.

A specific configuration of the sheet conveyance portion 100 of the present embodiment will be described with reference to FIG. 2. FIG. 2 is a perspective view illustrating a configuration of a main part of the sheet conveyance portion 100.

The sheet conveyance portion 100 is disposed on a way of the conveyance path connecting the feed rollers 61*a*, 62*a*, 63*a* and 64*a* (see FIG. 1) with the image forming unit 115 (see FIG. 1). As illustrated in FIG. 2, the sheet conveyance portion 100 includes the registration roller pair 110 (an upper roller 110*a*, a lower roller 110*b*, and a registration roller rotary shaft 110*s*), a registration driving motor 111, and a registration roller input gear 112.

In the sheet conveyance portion 100, a registration roller idler gear 113 is disposed slightly upstream in the sheet conveyance direction A of the registration roller pair 110, and the pre-registration roller pair 120 is disposed upstream of the registration roller idler gear 113. The sheet conveyance portion 100 is also provided with a pre-registration driving motor 121, a registration sensor 140, a CIS 141, a shift motor 151, a large pinion gear 152*a*, a small pinion gear 152*b* and a rack 153.

The pre-registration driving motor 121 rotationally drives the pre-registration roller pair 120 disposed on the sheet conveyance path. The registration driving motor 111 rotationally drives the registration roller pair 110 through the registration roller idler gear 113 and the registration roller input gear 112.

The registration roller pair 110 is composed of the upper roller 110*a* disposed on an upper side and the lower roller 110*b* fixed to the registration roller rotary shaft 110*s* and disposed on a lower side. The registration roller rotary shaft 110*s* is supported by the apparatus body 10*a* (see FIG. 1) movably in the width direction H orthogonal to the sheet conveyance direction A. Still further, the upper roller 110*a* is supported so as to move in a body with the lower roller 110*b* when the registration roller rotary shaft 110*s* moves in the width direction of the sheet S.

A rack 153 is provided at one end of the registration roller rotary shaft 110*s*. The rack 153 is supported so as to be movable integrally with the registration roller rotary shaft 110*s* in an axial direction of the registration roller rotary shaft 110*s* and so as to be able to freely rotate the registration roller rotary shaft 110*s* without rotating in a circumferential direction of the registration roller rotary shaft 110*s*.

The registration roller rotary shaft 110*s* is supported movably in the width direction H in a condition in which the rack 153 is meshed with a pinion gear 152*b* and the upper roller 110*a*, the lower roller 110*b*, a registration roller input gear 112 and others are held in a body. That is, the registration roller rotary shaft 110*s* moves in the axial direction (in the width direction H) together with the rack 153 when the pinion gear 152*b*, to a driving force of the shift motor 151 is transmitted, rotates. Thereby, the sheet S nipped by the registration roller pair 110 moves in the width direction. Thus, the shift operation of the registration roller pair 110 is realized through intermediary of the pinion gear 152*b* and the rack 153.

A width of teeth of the registration roller idler gear 113 is wider than that of the registration roller input gear 112 to keep the mesh of the gears and to continue the rotation of the registration roller pair 110 even in a case when the registration roller pair 110 and the registration roller input gear 112 move in the width direction.

The CIS 141 detecting the side edge position of the sheet S is disposed upstream in the sheet conveyance direction A of the registration roller pair 110. The CIS 141 is disposed at a position deviating from a center part of the width direction H of the sheet S in FIG. 2 (on a left side of FIG. 2 with respect to the sheet conveyance direction A in the present embodiment). It is because it is only necessary to detect the side edge position of one side of the sheet to correct the position of the sheet in the present embodiment.

The CIS 141 is configured to be able to detect a side edge position of the sheet S whose widthwise size is smallest and a side edge position of the sheet S whose widthwise size is largest, respectively, among sheet sizes permitted to use in the image forming apparatus 10. The CIS 141 is disposed at a position close to the registration roller pair 110 as much as possible in order not to drop detection precision of the CIS 141. Desirably, a conveyance guide gap not illustrated of the CIS 141 is made uniform to provide a space in which the deflection generated in the sheet is stored between the CIS 141 and the pre-registration roller pair 120. It is because the defection is generated in the sheet S between the pre-registration roller pair 120 and the registration roller pair 110 to correct a skew as described above.

Control System

The control system configured to control the respective components of the image forming apparatus 10 will be described with reference to FIG. 3. It is noted that FIG. 3 is a block diagram illustrating the control system of the image forming apparatus 10.

Figure 3:
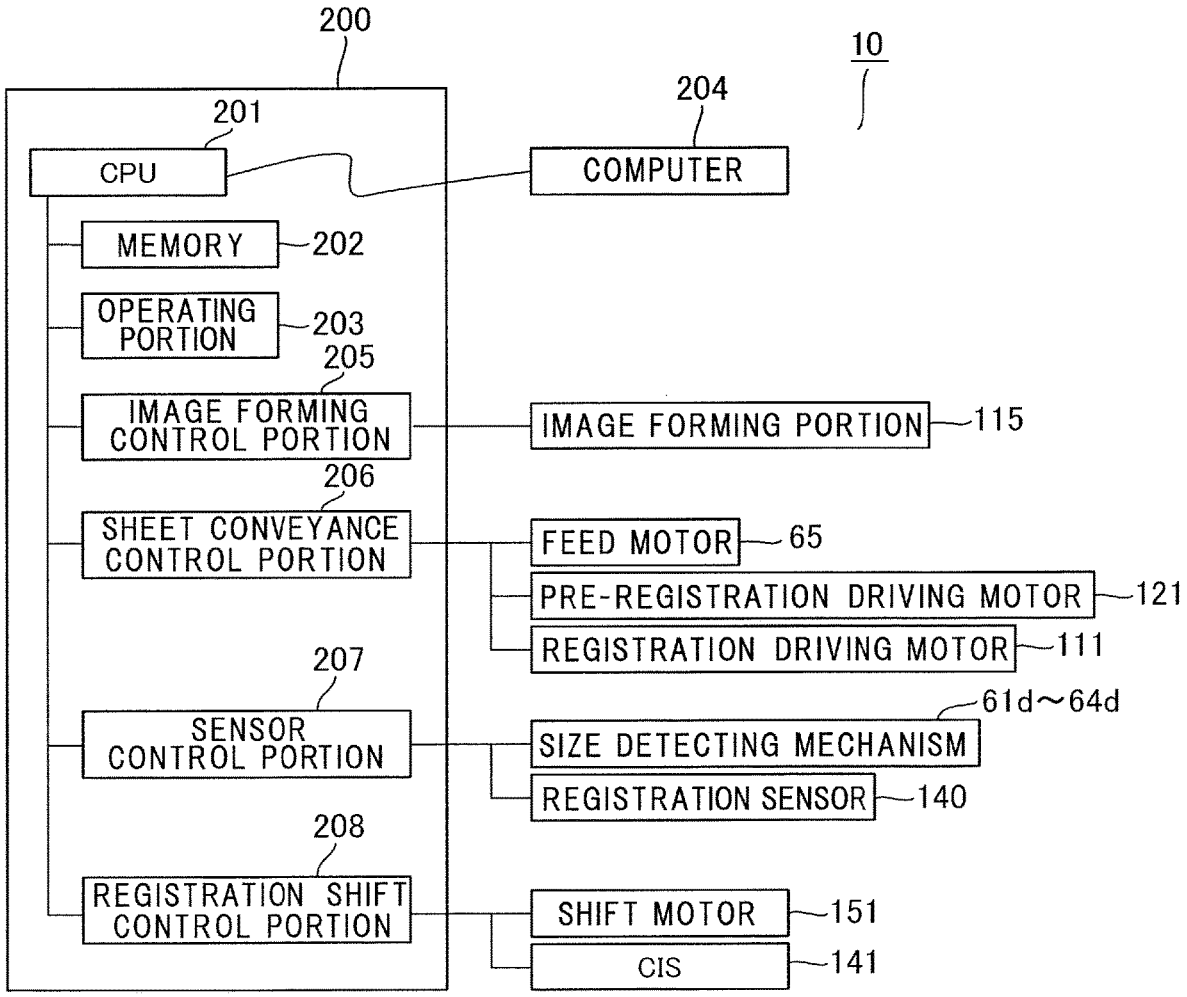
FIG. 3 is a block diagram illustrating a control system of the image forming apparatus of the first embodiment.

As illustrated in FIG. 3, the control portion 200 includes functional portions such as a CPU (Central Processing Unit) 201, a memory 202, an operating portion 203, an image formation control portion 205, a sheet conveyance control portion 206, a sensor control portion 207, a registration and shift control portion 208 and others.

The CPU 201 realizes various processes conducted by the image forming apparatus 10 by executing predetermined control programs and others. The memory 202 is composed of a RAM (Random Access Memory), a ROM (Read Only Memory) and others and stores various programs and data in predetermined storage areas. The operating portion 203 is disposed at an adequate position where a user can readily see in the apparatus body 10*a*. The operating portion 203 accepts various information, e.g., size information, basis weight information, information on surface nature, and others, regarding a sheet to be used in printing and various operations made by the user such as execution of printing and an instruction of its stop.

The image formation control portion 205 issues instructions to the image forming unit 115 including the exposure unit 13 to control an image forming operation. The sheet conveyance control portion 206 issues instructions to a feed motor 65, a pre-registration driving motor 121, a registration driving motor 111 and others to control the conveyance of the sheet S. The feed motor 65 rotationally drives a feed roller which has been switched among the feed rollers 61*a*, 62*a* and 63*a*. The pre-registration driving motor 121 rotationally drives the pre-registration roller pair 120. The registration driving motor 111 rotationally drives the registration roller pair 110.

The sensor control portion 207 controls start and stop of detection of the size detecting mechanisms 61*d*, 62*d*, 63*d* and 64*d* (see FIG. 1) and the registration sensor 140 and others, and receives detection results of these sensors. The registration and shift control portion 208 receives the detection result of the CIS 141, instructs to start or stop the drive of the shift motor 151, and controls the shift operation in the width direction of the registration roller pair 110 (adjustment portion) in the sheet conveyance portion 100. It is noted that it is possible to configure so as to receive various information regarding the sheet to be used in printing through a computer, e.g., the computer 204 illustrated in FIG. 3, connected through a network for example.

As described above, the controller is composed of the control portion 200 and the shift motor 151. This controller is configured to convey the sheet while adjusting the shift of the first surface by the registration roller pair 110 based on a first image drawing position $g_1$ drawn by the image forming unit 115 set in advance and on the side edge position detected by the CIS (detection portion) 141 on the first surface upstream of the registration roller pair 110. It is noted that the first image drawing position, i.e., a first image position, is a position where the image to be transferred onto the first surface of the sheet is started to be drawn onto the photosensitive drums 11Y, 11M, 11C, and 11Bk. The second image drawing position, i.e., a second image position, is a position where the image to be transferred onto the second surface of the sheet is started to be drawn to the photosensitive drums 11Y, 11M, 11C, and 11Bk.

Based on the position on the first trailing part of the side edge $L_{1b}$ detected by the CIS 141 at the trailing part of the first surface of the sheet (see FIG. 6), the controller (151, 200) also determines a second image drawing position $g_2$ (second image drawing start position). The second image drawing position $g_2$ is a position where drawing is started onto the photosensitive drums 11Y, 11M, 11C, and 11Bk by the image forming unit 115 corresponding to the second surface of the sheet reversed by the reverse and re-conveyance portion 102 and conveyed again to the registration roller pair 110. Still further, the controller (151, 200) determines a shift amount of the registration roller pair 110 with respect to the second surface of the sheet based on the position on the second leading part of the side edge $L_{2t}$ of the sheet detected by the CIS 141 (see FIG. 6) with respect to the second image drawing position $g_2$. That is, the controller determines the shift amount of the registration roller pair 110 with respect to the sheet reversed and conveyed again by the reverse and re-conveyance portion 102 based on the second image drawing position $g_2$ and on the side edge position (position on the second leading part of the side edge $L_{2t}$) of the sheet conveyed again by the reverse and re-conveyance portion 102 and detected by the CIS 141.

It is noted that the first image drawing position $g_1$ onto the first surface means a drawing start position when the exposure units 13Y through 13Bk draw images on the corresponding photosensitive drums 11Y through 11Bk by scanning and exposing the photosensitive drums 11Y through 11Bk with laser beams or the like based on values stored in the memory 202. Still further, while the second image drawing position $g_2$ is determined based on the position on the first trailing part of the side edge $L_{1b}$, this value also means a drawing start position in drawing images respectively on the photosensitive drums 11Y through 11Bk.

According to the present embodiment, the controller (151, 200) determines the second image drawing position $g_2$ of the sheet (second image drawing start position) by using the position on the first trailing part of the side edge $L_{1b}$ of the sheet as it is. Thereby, the control on the shift correction by the registration roller pair 110 is simplified more.

Still further, according to the present embodiment, the controller (151, 200) determines the shift amount of the registration roller pair 110 with respect to the first surface based on a difference between the position on the first leading part of the side edge $L_{1t}$ and on the first image drawing position $g_1$ to the first surface. The position on the first leading part of the side edge $L_{1t}$ is positional data detected by the CIS (detection portion) 141 at the leading part of the first surface of the sheet.

The CIS 141 detects the position on the first trailing part of the side edge $L_{1b}$ at the trailing part of the first surface of the sheet during when the trailing part of the sheet passes through the detection portion after the shift operation of the registration roller pair 110 (adjustment portion) to the second surface of the sheet (see FIG. 6B). This arrangement makes it possible to reliably detect the position on the first trailing part of the side edge $L_{1b}$ by the CIS 141.

The pre-registration roller pair 120, i.e., a rotator pair, is disposed upstream in the sheet conveyance direction A of the registration roller pair 110 (see FIG. 1). The pre-registration roller pair 120 functions so as to correct a skew of the sheet being conveyed by the registration roller pair 110 by butting the leading edge of the sheet against and by pushing the leading edge into the nip portion N of the registration roller pair 110 by a predetermined amount.

Processing Procedure of Shift Processing of Sheet

Figure 4:
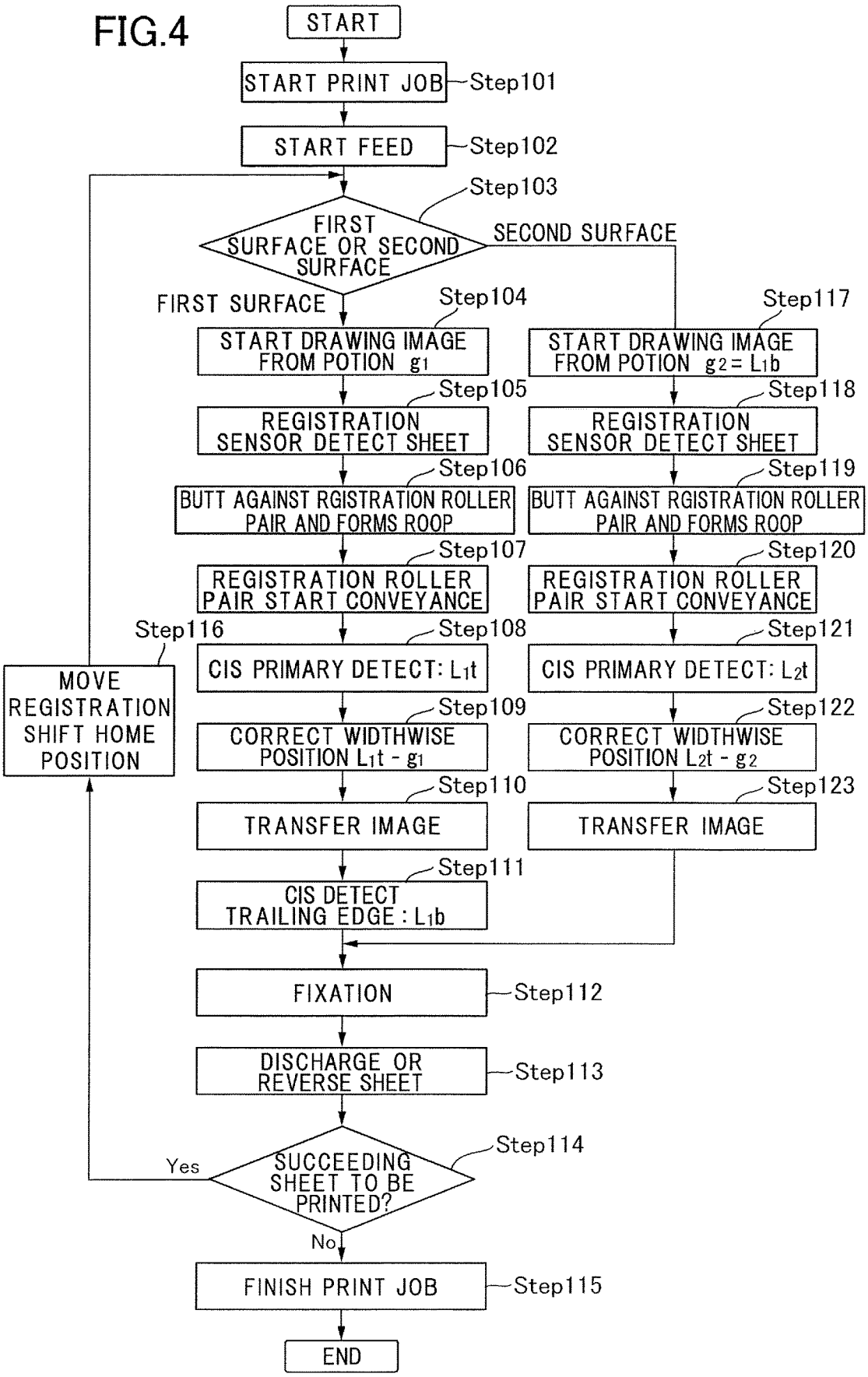
FIG. 4 is a flowchart illustrating a procedure of a shift process of the image forming apparatus.
Figure 5A:
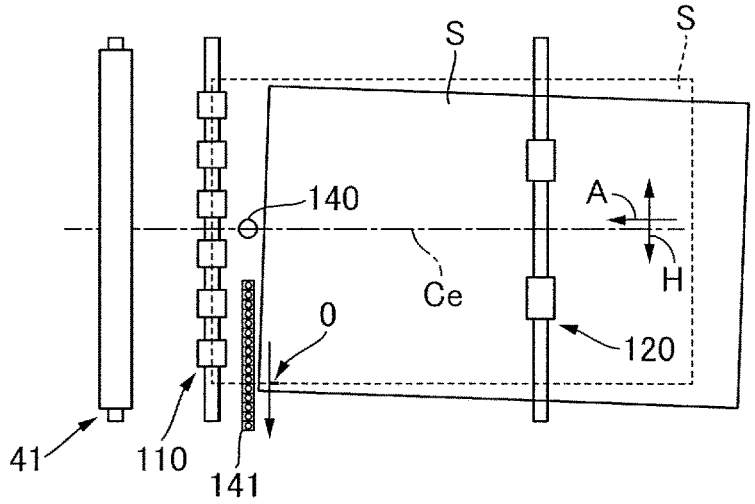
FIG. 5A is a plan view illustrating a condition in which a skew of a sheet is to be corrected in the first embodiment.
Figure 5B:
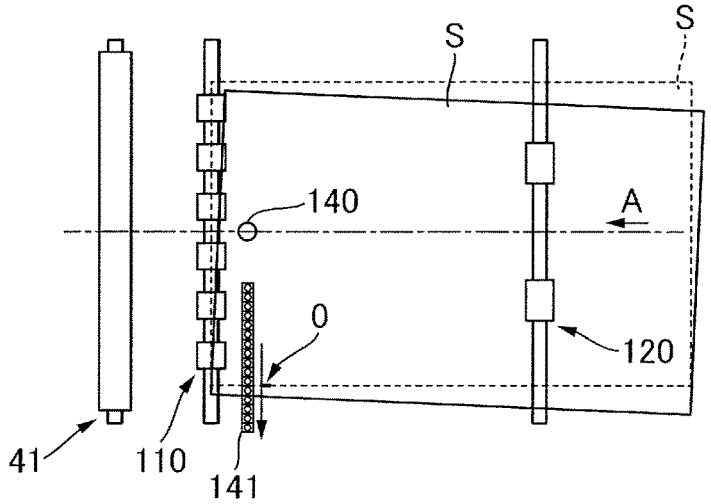
FIG. 5B is a plan view illustrating a condition in which the sheet in FIG. 5A is in abutment with a nip portion of a registration roller pair.
Figure 5C:
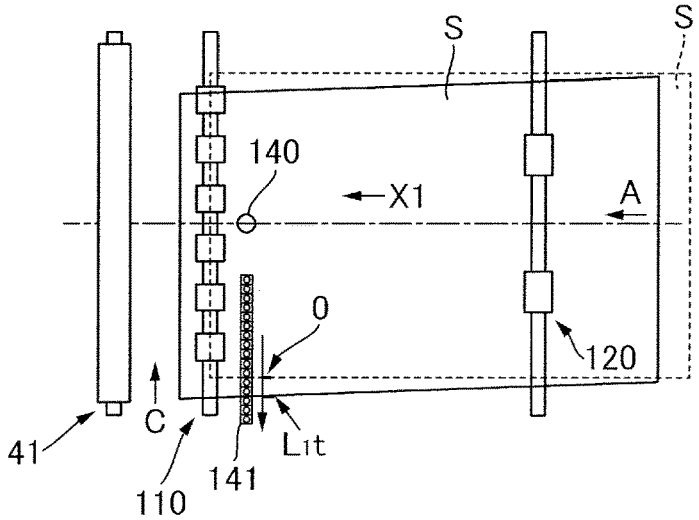
FIG. 5C is a plan view illustrating a condition in which the sheet in FIG. 5B is conveyed by the registration roller pair.

Next, a processing procedure of the shift process of a sheet will be described with reference to FIG. 4, FIGS. 5A through 5C and FIGS. 6A through 6C. It is noted that FIG. 4 is a flowchart illustrating the shift processing procedure of the image forming apparatus 10. FIGS. 5A through 5C are plan views sequentially illustrating the skew correcting operation and the widthwise position correcting operation of the sheet in the sheet conveyance portion 100 of the present embodiment. FIGS. 6A through 6C are plan views sequentially illustrating the skew correcting operation and the widthwise position correcting operation of the sheet in the sheet conveyance portion 100 of the present embodiment.

In response to an acceptance of an instruction given through the operating portion 203 or the computer 204 from the user to execute printing, the control portion 200 starts a print job in Step 101. It is noted that the user can specify a type or the like of a sheet to be used in printing as well as a number of sheets to be printed. The control portion 200 also obtains information on the sheets respectively stacked in the sheet storage sheds 61 through 63 and the manual feed portion 64 through the size detecting mechanisms 61*d* through 64*d* (see FIGS. 1 and 3).

The control portion 200 drives the feed motor 65 to start to feed the sheet S in Step 102 and judges whether the print job is to be conducted on the first surface or on the second surface in Step 103. When it is judged that the printing job is to be conducted on the first surface, i.e., First Surface in Step 103, the control portion 200 starts to draw images by the exposure units corresponding to the photosensitive drums 11Y through 11Bk from the first image drawing position $g_1$ predetermined in the image forming unit 115 in Step 104. The first image drawing position $g_1$ is a value based on a result of adjustment of drawing position conducted in shipping the apparatus from a factory and is stored in the memory 202 (see FIG. 3) as a fixed value intrinsic to an apparatus body.

Meanwhile, the sheet S fed by any one of the feed roller 61*a*, 62*a*, 63*a* and 64*a* is conveyed to the pre-registration roller pair 120. At this time, it is assumed that the sheet S is obliquely conveyed while turning clockwise with respect to the sheet conveyance direction A and in a condition in which a trailing edge part thereof deviates on a left side with respect to the sheet conveyance direction A as illustrated in FIG. 5A. A rectangle illustrated in FIG. 5A by a broken line diagrammatically indicates a condition in which a leading edge of the sheet S conveyed without any skew and lateral deviation butts against the nip portion of the registration roller pair 110. A widthwise side edge position at this time is denoted as a point zero and the left side thereof as a plus direction. It is noted that a reference character Ce in FIG. 5A indicates a center position of the width direction H of the sheet S illustrated as the broken rectangle.

The leading edge of the sheet S being conveyed butts against the nip portion of the registration roller pair 110 being at a standstill. Based on the detection result of the registration sensor 140 (see also FIG. 1), the control portion 200 drives the pre-registration roller pair 120 to feed the sheet by a feed amount set in advance to form the sheet with a predetermined amount of deflection in Step 106 (see FIG. 5B). Thereby, the leading edge of the sheet S follows the nip portion and the skew thereof is corrected. After that, the sheet S is put into a condition as illustrated in FIG. 5C when the registration roller pair 110 is rotationally driven and the conveyance is started under the control of the control portion 200 in Step 107.

The control portion 200 detects (primary detection), by the CIS 141, the side edge position at the leading edge in the sheet conveyance direction A of the sheet, whose skew has been corrected, in Step 108. Then, based on the position of the side edge on the first leading part $L_{1t}$ (result of the primary detection) of the first surface, the control portion 200 determines a sheet position correction amount (correction amount in the width direction H). The sheet position correction amount (shift amount) at this time can be obtained by subtracting the first image drawing position $g_1$ from the detected position (result of the primary detection) $L_{1t}$ on the leading part of the first surface of the side edge of the CIS 141 ($L_{1t}-g_1$). That is, the control portion 200 determines the shift amount by the registration roller pair 110 to the first surface based on the difference between the position of the side edge on the first leading part $L_{1t}$ detected by the CIS 141 at the leading part of the first surface and on the first image drawing position $g_1$ to the first surface (first image drawing start position). This arrangement makes it possible to simply and reliably determine the shift amount to the first surface. It is noted that the position of the side edge on the first leading part $L_{1t}$ of the CIS 141 is stored in the memory 202 for example.

The control portion 200 controls and drives the shift motor 151 by the registration and shift control portion 208 to shift the registration roller pair 110 conveying the sheet S by the sheet position correction amount ($L_{1t}-g_1$) in the width direction H in Step 109. FIG. 6A illustrates a condition in which the registration roller pair 110 has been shifted by the determined sheet position correction amount.

After that, the conveyance of the sheet by the registration roller pair 110 is continued further, and the image (toner image) is secondarily transferred onto the sheet in the secondary transfer portion T2 (see FIG. 1) including the secondary transfer outer roller 41. Then, as illustrated in FIG. 6B, the CIS 141 detects the side edge position at the trailing part at a position of predetermined amount $L_m$ set in advance right before the trailing edge part of the sheet S passes through the CIS 141 in Step 111. The position of the side edge on the first trailing part $L_{1b}$ which is a detection result of the trailing part of the first surface is stored in the memory 202 (see FIG. 3) for example. The control of detecting the side edge position at the trailing part of the sheet S is one of characteristic controls of the image forming apparatus 10 of the present embodiment.

It is rare that rectangularity of a sheet itself, i.e., an angle formed between a side of a leading edge in the sheet conveyance direction and a side on a left end of the sheet, is strictly 90 degrees in general. Because the image forming apparatus of the present embodiment corrects a skew of a sheet based on a leading edge of the sheet, if a distance from a perpendicular line drawn perpendicularly from the side of the leading edge and the left end side is offset, a shift is generated gradually in the width direction as the sheet is conveyed toward the trailing part even if the sheet is corrected in the width direction. That is, even if the sheet S is corrected to a position close to the first image drawing position $g_1$ by the shift operation at the leading part of the sheet S, the sheet shifts to the position of the side edge on the first trailing part $L_{1b}$ at the trailing part of the sheet S.

After Step 111, the control portion 200 fixes the toner image through the fixing unit 50 in Step 112. While the job finishes by discharging the sheet S on which the toner image has been fixed to the discharge portion 80 in Step 113 in a case of a simplex printing job, a process for reversing the sheet S is conducted in a case of a duplex printing job in order to form an image on a second surface of the sheet. The control portion 200 judges whether or not there is a succeeding sheet to be printed in Step 114. When it is judged that there is no succeeding sheet, i.e., No in Step 114, the control portion 200 finishes the printing job in Step 115. When it is judged that there is a succeeding sheet, i.e., Yes in Step 114, the control portion 200 returns the registration roller pair 110 to its home position (center position) in Step 116 and returns to the process in Step 103.

Then, if the control portion 200 judges that the printing job is to print on the second surface of the sheet, i.e., Second Surface in Step 103, the control portion 200 switches back and reverses the sheet S on which the image has been printed on the first surface by the duplex reverse roller pair 86. Then, the sheet is conveyed through the duplex conveyance path 90 again to the pre-registration roller pair 120. A characteristic point here is that the trailing part of the first surface is switched to the leading part of the second surface in the switchback and reverse operation. Then, if the rectangularity of the sheet S is not favorable, it is known that the position of the side edge on the first trailing part $L_{1b}$ which is the detection result of the trailing part in forming the image on the first surface correlates with the position of the side edge on the second leading part $L_{2t}$ which is the detection result of the leading part in forming the image on the second surface. Actually, dislocation caused during the conveyance through the duplex conveyance path 90 is added in general.

In view of the abovementioned phenomenon, the control portion 200 calculates and determines the second image drawing position $g_2$ of the second surface based on the position of the side edge on the first trailing part $L_{1b}$ in the present embodiment. Here, the second image drawing position $g_2$ is equalized with the first image drawing position $g_1$ of the first surface in Step 117. That is, the control portion 200 determines the second image drawing position $g_2$ by using the position of the side edge on the first trailing part $L_{1b}$ of the sheet as it is. In Step 117, images are drawn to the photosensitive drums 11Y through 11Bk corresponding to the exposure units 13Y through 13Bk from the second image drawing position $g_2$ in the image forming unit 115. A skew correcting operation conducted by the registration roller pair 110 to the second surface of the sheet S is carried out in the same manner with the case of the first surface in Steps 118, 119 and 120. Then, primary detection of the second surface is carried out during the conveyance to the secondary transfer portion T2 to detect a side edge position at the second leading part $L_{2t}$ in Step 121 (see FIG. 6C).

The control portion 200 determines a sheet position correction amount to the second surface based on the position of the side edge on the second leading part $L_{2t}$ (the primary detection result). The sheet position correction amount of this time is determined based on the position of the side edge on the second leading part $L_{2t}$ of the sheet detected by the CIS 141 with respect to the second image drawing position $g_2$. That is, it is possible to obtain the sheet position correction amount by subtracting the second image drawing position $g_2$, i.e., the position of the side edge on the first trailing part $L_{1b}$, from the position of the side edge on the second leading part $L_{2t}$,i.e., the position of the side edge on the leading part in forming the image on the second surface, (primary detection result). In other words, the sheet position correction amount is obtained by $L_{2t}-L_{1b}$.

In a case of FIG. 6C, the first image drawing position $g_1$ of the first surface is assumed to be zero (g1=0) to simplify the description. That is, if the second image drawing position $g_2$ of the second surface is zero in a comparative example to which the present embodiment is not applied, a shift amount in the comparative example is calculated as $L_{2t}-0=L_{2t}$. As compared to this case, it can be understood that a shift amount of the registration roller pair 110 can be reduced because a shift amount calculated by $L_{2t}-L_{1b}$ of the present embodiment is smaller.

The control portion 200 controls the drive of the shift motor 151 by the registration and shift control portion 208 to shift the registration roller pair 110 conveying the second surface of the sheet by $L_{2t}-g_2$ as the sheet position correction amount, i.e., by $L_{2t}-L_{1b}$ in Step 122. Processes on after an image transfer process (Step 123) after the abovementioned processes are the same with the case of printing the first surface in Steps 112 through 115, their description will be omitted here.

Figure 7:
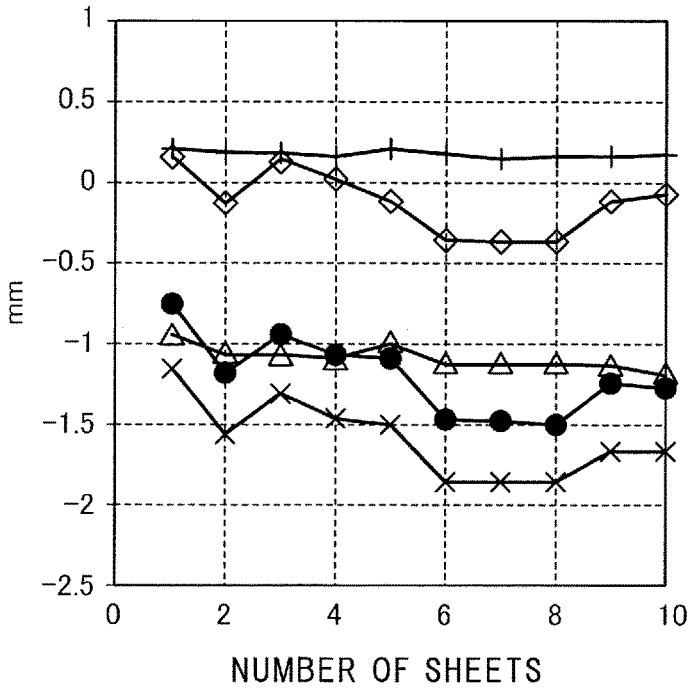
FIG. 7 is a graph indicating registration shift amounts plotted when ten sheets are continuously conveyed (fed) in the image forming apparatus of the first embodiment.

FIG. 7 is a graph plotting the positions on first leading parts of the side edge $L_{1t}$ (primary detection result) and the first position of the side edges on the trailing part $L_{1b}$ after the shift correction respectively with a case when the present embodiment is applied regarding the shift amount and a comparative example to which the present embodiment is not applied when 10 sheets are continuously fed in the image forming apparatus 10.

According to the graph illustrated in FIG. 7, detection results of the side edge position after correcting the shift of the first surface vary by around 0.1 to 0.2 mm and is very small. However, although the position of the side edge on the first trailing part $L_{1b}$ vary around −0.9 to −1.2 mm and is not so large, it is offset. This is caused by the shift of the rectangularity due to low cutting precision of the sheet S as described above. Due to that, it can be understood that a deviation of the position of the side edge on the second leading part $L_{2t}$ after the switchback and reverse is almost equal to that of the position of the side edge on the first trailing part $L_{1b}$ also in the minus direction.

Because the amount of the difference between the position of the side edge on the second leading part $L_{1t}$ and the position of the side edge on the first trailing part $L_{1b}$ is counted as the shift amount of the second surface in the present embodiment, the shift amount is suppressed around to −0.3 to +0.1 mm as indicated in FIG. 7. Meanwhile, it is apparent that the shift amount of the comparative example is swung significantly in the minus direction.

As described above, according to the present embodiment, the shift amount of the registration roller pair 110 to the second surface of the sheet S being conveyed is determined corresponding to the position of the side edge on the first trailing part $L_{1b}$ after the shift operation on the first surface. This arrangement makes it possible to reduce the shift amount of the registration roller pair 110 because the shift amount to the second surface is just the amount of the difference from the position of the side edge on the first trailing part $L_{1b}$ to the position of the side edge on the second leading part $L_{2t}$. This arrangement makes it possible to shorten a time consumed by the shift operation of the registration roller pair 110 and a return time after the shift operation. As a result, it is possible to improve productivity of the image forming apparatus and to prevent precisions of the shift correction and skew correction from dropping which may be otherwise caused by the large shift amount.

The image forming apparatus 10 of the present embodiment is provided with parts corresponding respectively to four colors in the image forming unit 115 and arrayed on the intermediate transfer belt 31 from such advantages that this arrangement excels in terms of adaptability to various kinds of sheets and in printing productivity. However, because a circumferential length of the intermediate transfer belt is long in forming a color image, it takes a relatively long period of time for the image on the belt to arrive at the secondary transfer portion from when the image of a first color has been drawn. It is possible to minimize the shift amount by the present embodiment even in such a configuration that a sheet conveyance distance is long in the image forming process in the intermediate transfer tandem system as described above.

The case when the rectangularity of the sheet S is not favorable has been exemplified in the abovementioned description, the present embodiment is not limited to such a case and may bring about advantageous effects even in a case when the sheet conveyance direction at the secondary transfer portion T2 is curved. A balance of pressures at both ends of a secondary transfer nip is apt to be lost because the sheet tends to slip by being affected by toner primarily transferred onto the intermediate transfer belt and because the secondary transfer outer roller 41 disposed so as to face the secondary transfer inner roller 32 is made of a sponge material or the like. Therefore, there is a case when a so-called skew by which the sheet is obliquely conveyed or a so-called turning by which a sheet conveyance direction of the sheet gradually curves. It is known that even in such a case, a side edge position deviates around a trailing edge part (trailing part) of the sheet and that the side edge position of the second surface after switchback and reverse correlates with the side edge position around the trailing edge part (trailing part) of the first surface.

While the case in which the CIS 141 is disposed right upstream in the sheet conveyance direction A of the registration roller pair 110 has been exemplified in the above description, the present embodiment is not limited to such case and may be a configuration in which the CIS 141 is disposed downstream in the sheet conveyance direction A of the registration roller pair 110. Still further, while the cases of butting the leading edge of the sheet against the registration roller pair 110 and of correcting a skew by forming a loop by the pre-registration roller pair 120 have been exemplified as a skew correcting method in the above description, the present embodiment is not limited to such cases. For instance, the same advantageous effects may be brought about by a configuration in which a planar shutter is provided as a member against which a sheet butts. This configuration has no direct relationship with the presence of the effects of the skew correcting method.

That is, while the registration roller pair 110 serves as the adjustment portion in the present embodiment, it is also possible to configure as described below if a shutter member 117 indicated by a broken line is disposed in a vicinity of the nip portion N of the registration roller pair 110 in FIG. 1 for example. That is, the shutter member 117 composes a part of the adjustment portion together with the registration roller pair 110. The shutter member 117 corrects a skew of the sheet while abutting with the leading edge of the sheet being conveyed. The vicinity of the nip portion N means an upstream or downstream part of the nip portion N. In this case, the controller composed of the control portion 200 and the shift motor 151 shifts the registration roller pair 110 and the shutter member 117 serving as the adjustment portion in the width direction H.

According to the present embodiment, because the second image drawing position $g_2$ is determined based on the detection result of the widthwise side edge position at the trailing part of the first surface of the sheet being conveyed, it is possible to minimize the shift amount to the second surface even if there is a deviation from rectangularity caused by cutting of the sheet itself and a deviation due to a skew while conveying the first surface. This arrangement makes it possible to bring about the effects of the improvement of productivity by shortening a shift return time and to prevent the sheet skew correcting operation from being deteriorated by the shift operation.

Second Embodiment

Figure 8:
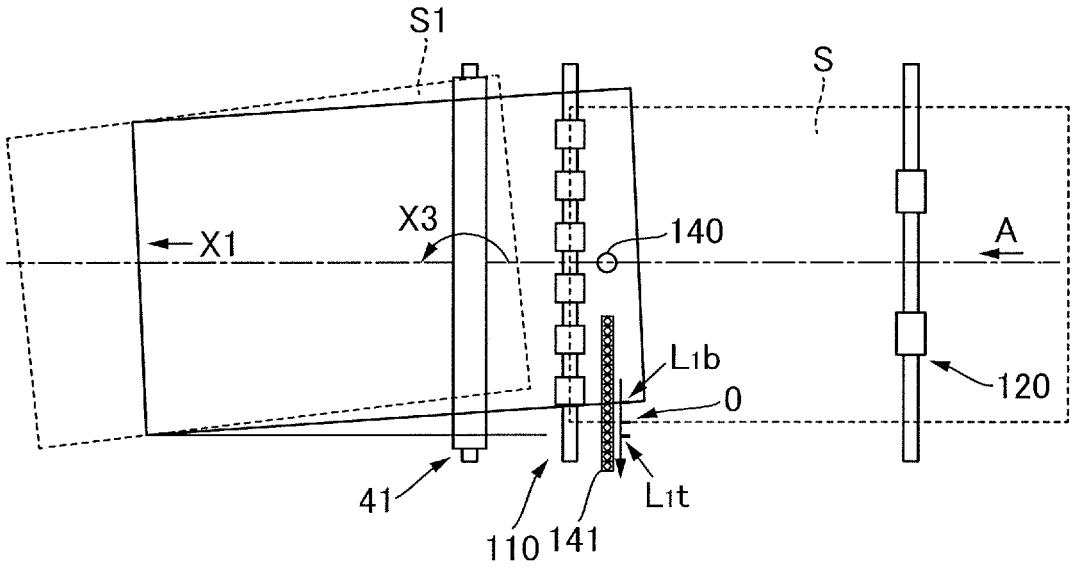
FIG. 8 is a plan view illustrating a shift operation of an image forming apparatus of a second embodiment.

Next, an image forming apparatus of a second embodiment will be described with reference to FIG. 8. FIG. 8 is a diagram illustrating a widthwise position correcting operation of the sheet S in the sheet conveyance portion 100 (see FIG. 1). It is noted that the same functional components with those described in the first embodiment will be denoted by the same reference numerals and their description will be omitted here in the present embodiment.

While the value of the second image drawing position $g_2$ of the second surface is equalized with that of the position of the side edge on the first trailing part $L_{1b}$ in the first embodiment described above, these values are not always necessary to be equal and may be a value calculated based on the position of the side edge on the first trailing part $L_{1b}$. That is, according to the present embodiment, the second surface image drawing position $g_2$ is a value obtained by multiplying a correction factor $\alpha$ to the value of the difference between the first image drawing position $g_1$ and the position of the side edge on the first trailing part $L_{1b}$ of the trailing part of the first surface as follows:

$$g_2=\alpha(L_{1b}-g_1)$$

That is, according to the present embodiment, the controller (151, 200) determines the second image drawing position $g_2$ of the sheet based on the value obtained by multiplying the correction factor $\alpha$ to the difference between the position of the side edge on the first trailing part $L_{1b}$ and the first image drawing position $g_1$ to the first surface of the sheet.

FIG. 8 illustrates a case in which the sheet S is conveyed at the secondary transfer portion T2 (see FIG. 1) reversely from the case of the first embodiment described above, i.e., a case in which the sheet is conveyed while turning counterclockwise with respect to the sheet conveyance direction A. It can be seen that the side edge position is dislocated further until when the trailing part passes through the secondary transfer portion T2 with respect to the position of the side edge on the first trailing part $L_{1b}$ right before when the trailing part of the sheet S passes through the CIS 141 (see a broken line S1 in FIG. 8).

Accordingly, because the deviation of the position of the side edge on the second leading part $L_{2t}$ is amplified more than the position of the side edge on the first trailing part $L_{1b}$ more or less, it is possible to reduce a shift amount to the second surface more by setting the correction factor $\alpha$ to a value greater than 1, e.g., 1.2. Meanwhile, it is also possible to set the value of the correction factor $\alpha$ to be smaller than 1. The correction described above is a control for estimating the side edge position of the second surface to the end and may bring about adverse effects in some cases. In such a case, it is possible to minimize ill effects by setting the correction factor to be smaller than 1.

The correction factor $\alpha$ may be set in the memory 202 (see FIG. 3) as an independent value depending on the type, size, basis weight and surface nature of the sheet. It is because the conveyance deviation of the sheet at the secondary transfer portion T2 often differs depending on such characteristics of the sheet.

Thus, the correction factor $\alpha$ is set in advance as an individual value different per type of sheets based on sheet information regarding usable sheets in the present embodiment. The sheet information is information regarding at least one among the type, size, basis weight and surface nature of the sheet being conveyed. Thereby, it is possible to obtain the same advantageous effects with those of the first embodiment and to reduce the shift amount to the second surface more.

Third Embodiment

Next, an image forming apparatus of a third embodiment will be described. While the first image drawing position $g_1$ has been set as an intrinsic value intrinsic to the apparatus body in the first embodiment, the first image drawing position $g_1$ needs not be always intrinsic and such a control of sequentially changing the value during a continuous feed may be made.

That is, with respect to an operation of drawing an image on a first surface of a $n^{th}$ sheet during the continuous feed, a position of the side edge on the first trailing part $L_{1b}$ at a trailing part of a first surface of a preceding $(n-m)^{th}$ sheet (m is an integer greater than 1) is stored in the memory 202 (see FIG. 3) in advance. Then, it is possible to minimize a shift amount of the $n^{th}$ sheet by setting a side edge position at the trailing part as the first image drawing position $g_1$ of the $n^{th}$ sheet. Thus, according to the present embodiment, the first image drawing position $g_1$ of the image to be formed on the first surface of the sheet by the image forming unit 115 is set in advance based on the position of the side edge on the first trailing part $L_{1b}$ of the preceding sheet conveyed toward the registration roller pair 110. It is possible to obtain the same advantageous effects with those of the first embodiment also by the present embodiment described above.

While the first through third embodiments described above specifically describe the present disclosure, a scope of the present disclosure is not limited those embodiments. It is also noted that while those embodiments have been described by exemplifying the electro-photographic image forming apparatus, those embodiments are also applicable to an ink-jet type image forming apparatus configured to form an image onto a sheet by injecting ink drops from nozzles.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-027062, filed Feb. 16, 2016, which is hereby incorporated by reference wherein in its entirety.

What is claimed is:

1. An image forming apparatus, comprising:

an image bearing member;

an image forming portion configured to form an image on the image bearing member;

a transfer portion comprising a transfer nip portion in which a transfer roller contacts the image bearing member and configured to transfer the image on the image bearing member to a sheet;

a moving portion disposed upstream of the transfer portion with respect to a sheet conveyance direction and configured to move a sheet in a width direction orthogonal to the sheet conveyance direction;

a detection portion configured to detect one side edge position of a sheet in the width direction;

a reverse and re-conveyance portion configured to reverse a sheet which is conveyed with a first end being a leading edge and a second end opposite to the first end being a trailing edge in the sheet conveyance direction and of which a first image has been transferred onto a first surface, and to re-convey a reversed sheet with the second end being the leading edge and the first end being the trailing edge in the sheet conveyance direction toward the moving portion for transferring a second image onto a second surface opposite to the first surface of the sheet; and a controller, wherein in a case that the first image is transferred onto the first surface of the sheet, the controller is configured to determine a first moving amount of the moving portion based on information of a first image position in the width direction where the first image is borne on the image bearing member and information of a leading side edge position, detected by the detection portion, of the sheet conveyed with the first end being the leading edge, and to cause the moving portion to move the sheet by the first moving amount before the first end as the leading edge of the sheet arrives at the transfer nip portion, wherein in a case that the second image is transferred onto the second surface of the sheet, the controller is configured to determine a second image position in the width direction where the second image is borne on the image bearing member based on information of a trailing side edge position, detected by the detection portion, of the sheet conveyed with the first end being the leading edge, to cause the image forming portion to form the second image at the second image position, and to determine a second moving amount of the moving portion based on the second image position and information of a side edge portion, detected by the detected portion, of the reversed sheet, and to cause the moving portion to move the reversed sheet conveyed with the second end being the leading edge by the second moving amount before the second end as the leading edge of the reversed sheet arrives at the transfer nip portion, and wherein the trailing side edge position of the sheet conveyed with the first end being the leading edge is detected by the detection portion in a state where the first end of the sheet is positioned downstream of the transfer nip portion and the second end of the sheet is positioned upstream of the transfer nip portion after the moving portion moves the sheet by the first moving amount.

2. The image forming apparatus according to claim 1, wherein the controller is configured to move the sheet conveyed with the first end being the leading edge in the width direction by the moving portion before the first image is transferred onto the first surface based on the information of the first image position and the leading side edge position of the sheet detected by the detection portion before the first image is transferred onto the first surface.

3. The image forming apparatus according to claim 2, wherein after the moving portion moves the first surface of the sheet in the width direction, the detection portion is configured to detect the side edge position of the sheet again as the trailing side edge position, and the controller is configured to adjust the second image position based on the information of the trailing side edge position.

4. The image forming apparatus according to claim 1, wherein the controller determines the second image position based on a value obtained by multiplying a correction factor with a difference between the trailing side edge position, which is a side edge position of a trailing part of the sheet conveyed with the first end being the leading edge, and the first image position, and wherein the trailing part of the sheet is positioned between a center position and a trailing edge of the sheet in the conveyance direction.

5. The image forming apparatus according to claim 4, wherein the correction factor is set in advance as an individual value different per type of sheets based on sheet information regarding usable sheets.

6. The image forming apparatus according to claim 5, wherein the sheet information relates to at least one of type, size, basis weight and surface nature of the sheet to be conveyed.

7. The image forming apparatus according to claim 1, wherein the controller is configured to determine the first moving amount by which the moving portion moves the sheet before the first image is transferred onto the first surface of the sheet based on the information of the leading side edge position, detected by the detection portion, of the sheet conveyed with the first end being the leading edge.

8. The image forming apparatus according to claim 1, wherein the detection portion is configured to detect the trailing side edge position, which is a side edge position of a trailing part of the sheet conveyed with the first end being the leading edge, after the moving portion has moved the sheet in the width direction based on the information of the leading side edge position, detected by the detection portion, of the sheet conveyed with the first end being the leading edge, and wherein the trailing part of the sheet is positioned between a center position and a trailing edge of the sheet with respect to the sheet conveyance direction.

9. The image forming apparatus according to claim 1, wherein the first image position on the image bearing member of the first image to be transferred onto a first surface of a succeeding sheet is set based on a side edge position of a trailing part of a preceding sheet conveyed to the transfer portion preceding the succeeding sheet, and wherein the trailing part of the sheet is positioned between a center position and a trailing edge of the sheet with respect to the sheet conveyance direction.

10. The image forming apparatus according to claim 1, further comprising a rotator pair disposed upstream of the moving portion with respect to the sheet conveyance direction and configured to butt the leading edge of the sheet against the moving portion for correcting a skew of the sheet by the moving portion.

11. The image forming apparatus according to claim 1, wherein the moving portion comprises a registration roller pair against which the leading edge of the sheet being conveyed butts such that a skew of the sheet is corrected.

12. The image forming apparatus according to claim 1, wherein the moving portion comprises a shutter member against which the leading edge of the sheet being conveyed butts such that a skew of the sheet is corrected.

13. The image forming apparatus according to claim 1, wherein the controller is configured to adjust the second image position on the image bearing member in the width direction based on the information of the trailing side edge position, which is a side edge position of a trailing part of the sheet, and wherein the trailing part of the sheet is positioned between a center position and a trailing edge of the sheet with respect to the sheet conveyance direction.

14. The image forming apparatus according to claim 1, wherein the second moving amount is equal to or less than 0.5 mm.

* * * * *